US005205316A

United States Patent [19]

Pruett

[11] Patent Number: 5,205,316

[45] Date of Patent: Apr. 27, 1993

[54] AIR/WATER VOLUME CONTROL SYSTEM

[76] Inventor: Kearney L. Pruett, P.O. Box 297, Keithville, La. 71047

[21] Appl. No.: 941,532

[22] Filed: Sep. 8, 1992

Related U.S. Application Data

[63] Continuation-in-part of Ser. No. 789,014, Nov. 7, 1991, abandoned.

[51] Int. Cl.[5] ..... F04F 1/00

[52] U.S. Cl. ..... 137/209; 137/211.5

[58] Field of Search ..... 137/209, 211.5; 417/38, 417/40

[56] References Cited

U.S. PATENT DOCUMENTS

| | | | |
|---|---|---|---|
| 1,372,928 | 3/1921 | Barton | 137/209 |
| 1,849,602 | 3/1932 | Watry | 137/209 |
| 2,132,132 | 10/1938 | Seat | 137/209 |
| 2,318,066 | 5/1943 | Dodd | 137/209 X |
| 2,479,247 | 8/1949 | Matthews | 137/211.5 |

*Primary Examiner*—Alan Cohan
*Attorney, Agent, or Firm*—John F. Sieberth

[57] ABSTRACT

Apparatus is described for controlling the volumes of water and headspace air in a water storage/delivery tank of an individual water well system that includes a pump for maintaining water within the storage/delivery tank and for maintaining the pressure in the tank within preselected limits. The apparatus enables the water level within the tank to be assessed, the air pressure within the tank to be assessed, and the respective volumes of headspace air and water within the tank to be adjusted independently of the pump. Three versions of the apparatus are described: a manually operated system, a semi-automatic system, and a fully automatic system. Use of the apparatus overcomes problems associated with the absorption of the air within the tank and resultant water-logging of the tank. Once this occurs, the pump is caused to switch on and off to an excessive extent. This in turn results in excessive power consumption and wear and tear on the pump and its associated motor, to say nothing of the nuisance the dwelling occupants experience because of such frequent stops and starts of the motorized pump.

20 Claims, 4 Drawing Sheets

AIR/WATER VOLUME CONTROL SYSTEM

REFERENCE TO RELATED APPLICATION

This is a continuation-in-part of prior copending application Ser. No. 07/789,014 filed Nov. 7, 1991 now abandoned.

TECHNICAL FIELD

This invention relates to apparatus for controlling the volumes of water and headspace air in a water storage/-delivery tank of an individual water well system.

BACKGROUND

The individual water well systems with which this invention is concerned have intermittent flow and involve limited water consumption, in most cases amounting to up to no more than about 1500 gallons of water per day (i.e., in 24 hours). Such systems comprise in essence, a tank, a pump for delivering water from the well into the tank, and piping or like means for conducting water from the tank to selected locations. Because of the intermittent flow and small daily water usage in such systems, the pump which is used to pump the water into the tank is also utilized to compress the air trapped within the headspace in the tank above the water level. This compressed headspace air acts in the manner of a compressed spring and thus provides the force that drives the water through the piping system.

The "on/off" operation of the water well system is controlled by a pressure switch which is preset at a low pressure "on" and a higher pressure "off". In a 42-gallon tank the "on" setting is typically 20 to 30 psi so that when the pressure within the tank reaches such preset value, the pump is activated and additional water is pumped into the tank until the pressure reaches the preset "off" setting, typically somewhere in the range of 40 to 60 psi. As the water within the tank is drawn down, the air space is increased and accordingly, the pressure within the tank is reduced. The draw down volumes are not directly proportional to the pressure changes and therefore the higher "cut-in" and "cut-off" pressure limit switches may be preferred.

Unfortunately, in operation, systems of this type possess drawbacks and shortcomings. Air is water soluble. Moreover, when air and water are contained under pressure within a common container, the water will dissolve a greater quantity of air than it would at the same temperature under atmospheric pressure. Likewise, a reduction in temperature can also cause an increase in the volume of air absorbed or dissolved by the water.

The air absorbed by the water constitutes an air loss that occurs gradually over a period of time, and is governed to some extent by the water usage. As the air is absorbed, the water level in the storage tank continues to rise, which at the same time reduces the volume of water pumped into the tank per pump cycle (i.e., between the time the pump is activated and the time it is shut off). This can continue until such time as a draw down of, say, one gallon or less will cause a pump cycle. In typical 42-gallon systems, with an air/water volume ratio of 1:1, the pump will cycle on a 7.8 gallon draw down. Thus, for a 300 gallon per day water consumption, the standard 1:1 ratio computes into 40 pump cycles per day. On the other hand, if the tank becomes water-logged because of air absorption so that the pump delivers only one gallon per pump cycle, the pump would cycle 300 times per day. Consequently, the absorption of the air within the tank and resultant water-logging of the tank can, and often does, cause the pump to switch on and off to an excessive extent. This in turn results in excessive power consumption and wear and tear on the pump and its associated motor, to say nothing of the nuisance to the occupants of the dwelling of such frequent stops and starts of the motorized pump.

Heretofore systems have been devised to remedy this situation. However, such systems do not always measure up to the job for which they are intended. For example, some prior systems have employed apparatus which includes diaphragms which tend to deteriorate on aging. Also, some prior systems are incapable of delivering sufficient air to the storage tank to achieve optimal performance of the system. Other prior systems involving float control valves have been found on occasion to release air from the tank when there is actually a need to retain or increase the volume of air within the tank. Undue expense is still another shortcoming of some prior systems.

A need thus exists for an efficient, durable and economical system for overcoming these problems associated with the operation of individual water well systems so that the pump will not be caused to operate with excessive frequency, or worse yet, to fail.

BRIEF SUMMARY OF THE INVENTION

In accordance with this invention, there is provided apparatus for controlling the volumes of water and headspace air in a water storage/delivery tank of an individual water well system which includes a pump for maintaining water within said tank and for maintaining the pressure in the tank within preselected limits. The apparatus of this invention comprises (i) means assessing the water level within said tank, (ii) means assessing the air pressure within said tank, and (iii) means independent of said pump for adjusting the respective volumes of headspace air and water within said tank.

As will become apparent as the description proceeds, in one embodiment of this invention the apparatus involves a manually operated system for controlling the respective volumes of air and water within the tank. In another embodiment the apparatus is such that this control is effected semi-automatically. In still another embodiment of this invention the control is achieved by means of apparatus wherein the operation is fully automatic.

These and other embodiments and features of this invention will become still further apparent from the ensuing description, appended claims and accompanying drawings.

BRIEF DESCRIPTION OF THE DRAWINGS

In the drawings, wherein like numerals represent like parts among FIGS. 1–6.

DESCRIPTION OF PREFERRED EMBODIMENTS

Figure 1:
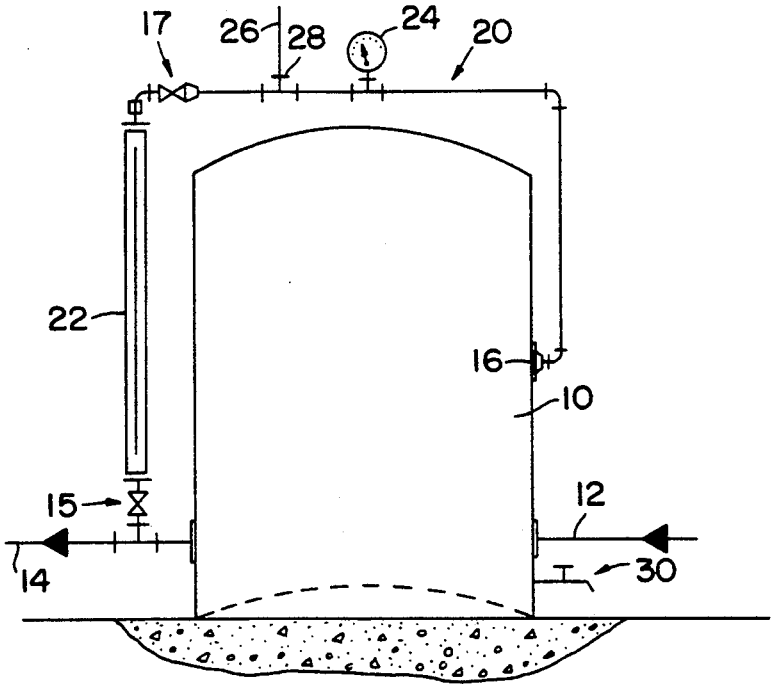
FIG. 1 is a schematic elevation illustrating a manually operated air/water volume control system of this invention.

As used in this description and in the claims the term "individual water well system" means a system for delivering water from a well to a limited number of outlets, usually on a single parcel of land, wherein there is intermittent water flow and limited water consumption, in most cases amounting to up to no more than about 1500 gallons of water per day (i.e., in a 24-hour period). In the water storage/delivery tanks of an individual water well system, an optimal water:headspace air volume ratio exists. When this ratio is at or close to this optimal ratio, the water pump does not "cycle'-'—i.e., operate—excessively as water is being drawn from the tank. However, for reasons already explained hereinabove, when this ratio becomes excessive—i.e., when the tank becomes water-logged—the usage of water causes the pump to operate excessively. While the magnitude of this problem may vary from system to system and to some extent can be somewhat subjective, the average occupant of a dwelling can readily determine whether the motor and pump of the system are operating more than they should as compared to when the system is operating according to its design specifications.

Manually controlled system. As can be seen from FIG. 1, a typical individual water well system comprises in essence a storage tank 10, a water inlet pipe 12 Which receives Water pumped from a well (not shown), a water outlet pipe 14, and an air outlet port 16 in tank 10. In accordance with this invention, a piping section 20 extends between outlet pipe 14 and port 16, and port 16 is utilized both as an air outlet and as an air inlet to tank 10. Piping section 20 includes sight glass 22 to enable visual observation of the water level within the tank. Piping section 20 also includes gauge 24 for reading the pressure within the tank. Connected to piping section 20 is an air conduit 26 for introducing pressurized air from a source (not shown in FIG. 1, but see FIGS. 2 and 3) such as an air pump or a tank containing pressurized air. Air conduit 26 in turn includes air valve 28 which enables control of the pressure within tank 10 by either allowing the escape of a suitable volume of air from the tank when the internal pressure therein is too high or allowing pressurized air in conduit 26 to be delivered into the tank when the internal pressure therein is too low. A manually operated valve and drain spout 30 is provided in tank 20 to enable water to be drawn off from the tank when necessary. It is preferable, though not essential, to provide gate valves 15 and 17 proximate the ends of sight glass 22 so that the sight glass can be removed when necessary (as when in need of cleaning) without appreciable loss of internal tank pressure.

After the foregoing system has been installed, the system is tested for leaks, for example at 60 psi internal air pressure. After correcting any leaks found to exist, the tank air pressure is adjusted to about 15 psi. Water pump power is turned on and sufficient water is pumped into the tank to allow for a pressure control switch cut-off at a preselected air pressure of, for example, 40 psi.

In order to determine when the volume ratio of water to headspace air within tank 10 is becoming excessive, use is made of sight glass 22 in conjunction with means such as a marked scale on or adjacent the sight glass showing the height of the water in the sight glass (and therefore in the tank as well), and a chart, tabulation, or other visual display which presents a preestablished optimal correlation between the height of such water level and the air pressure within the tank as read from gauge 24. For example, with cylindrical tanks of conventional dimensions and with capacities of 42, 82 and 120 gallons, the tabulations given in Tables I, II and III below are typical of optimal correlations that can be employed when using tank pressure control limits of 20 psi for water pump switch "on" and 40 psi for water pump switch "off". In Tables I, II and III, the gauge pressures are in pounds per square inch (psi), and the sight glass water levels represent the height in inches of the water in the tank as measured from the interior base of the tank.

TABLE I

| Desirable Correlations For a Standard 42-Gallon Tank | | | | |
|---|---|---|---|---|
| Gauge Pressure | 20 | 27 | 33 | 40 |
| Sight Glass Water Level | 15 | 17.5 | 19.38 | 20.75 |

TABLE II

| Desirable Correlations For a Standard 82-Gallon Tank | | | | |
|---|---|---|---|---|
| Gauge Pressure | 20 | 27 | 33 | 40 |
| Sight Glass Water Level | 27.0 | 32.38 | 35.5 | 38.25 |

TABLE III

| Desirable Correlations For a Standard 120-Gallon Tank | | | | |
|---|---|---|---|---|
| Gauge Pressure | 20 | 27 | 33 | 40 |
| Sight Glass Water Level | 27.5 | 33.0 | 36.14 | 38.88 |

Table IV sets forth typical water drawn down volumes for these respective water storage tanks.

TABLE IV

| Water Tank Volume | Typical Water Draw Down Volume |
|---|---|
| 42 gallons | 7.8 gallons |
| 82 gallons | 15.25 gallons |
| 120 gallons | 22.25 gallons |

Thus by adjusting the water height and the pressure within the tank to correspond to the appropriate desirable correlation such as presented in the above Tables I, II and III, the system will initially operate such that a pump cycle will occur only after a suitable water draw down volume such as shown in Table IV. This adjustment is readily accomplished by lowering the water level within the tank by draining water by means of valve and drain spout 30 or by increasing the air pressure within the tank by opening valve 28 to allow pressurized air to enter the system, or by conducting both such operations either concurrently or sequentially.

Periodically, the sight glass and pressure gauge are inspected to assess how far, if at all, the current ratio between water level and gauge pressure differs from the desirable correlation therebetween such as presented in the appropriate table above. It will be appreciated that the water level and gauge pressure readings are related to and thus reflect the volume ratio between water and headspace air within the tank. Thus the more the current ratio between water level and gauge pressure differs from the desirable correlation, the closer the system comes to reaching an undesirable increase in the volume ratio between water and headspace air within the tank. As a consequence, the tank can become water-logged and thereby causing the pump to cycle excessively, each time with only a small draw down of water. In severe cases of this type, pump cycling can be increased by as much as 700 to 800 percent.

Accordingly when in time the observer determines that a sufficient difference exists between the observed ratio of gauge pressure to water height and the desirable or optimal correlation as given for example in the appropriate above table, the water height and the pressure within the tank are adjusted as described above to again correspond to the appropriate desirable correlation. This procedure is periodically repeated as needed.

Semi-automatically controlled system. From FIG. 2 it can be seen that this system is basically the same as the manually controlled system described above, except that it further includes an air storage tank 40 equipped with a pressure gauge 46, a pressure regulator 42 and a float controlled air injection piping assembly 44. Tank 40 is designed to maintain a supply of air under positive gauge pressure, for example 100–200 psi. Float 45 is operatively connected to air valve 28 by a stem 43 so that the float will automatically open the air valve when the water level in the tank reaches a predetermined height above the float line. This enables pressurized air from tank 40 to enter tank 10 and thereby adjust the volume of air within tank 10. Pressure regulator 42 controls the pressure of the air entering tank 10 to a suitable level, such as for example 45 psi. Tank 40 is periodically recharged with air as needed, pressure gauge 46 associated therewith indicating when such recharging should be carried out.

As in the case of the manually controlled system described above, the sight glass water level and tank 10 pressure gauge readings are taken periodically. If the air pressure in tank 40 is sufficient to maintain the proper correlation of the conditions within tank 10, no adjustment will be necessary. But if the pressure in tank 40 is insufficient to maintain the proper correlation of the conditions within tank 10, tank 40 is repressurized so that such proper correlation can be reestablished. To insure that such repressurization is effected, a reading is taken on gauge 46 to see if the pressure in air tank 40 is within its predetermined limits. If not, for example if the pressure in air tank 40 is only, say 45 to 50 psi, the air tank should be recharged. In any instance where the readings of the sight glass and of the air pressure in water storage tank 10 are incompatible, pressure regulator 42 is tuned (adjusted) up or down as required to bring these readings back into proper balance.

Fully-automatically controlled system. This system, illustrated in FIG. 3, also includes the basic manually controlled system and in addition, an air storage tank 40 equipped with a pressure gauge 46, a pressure regulator 42 and a float controlled air injection piping assembly 44 as utilized in the above semi-automatical controlled system. Also included in the automatic system are an air compressor 50 with a pressure switch 52 and an interlock switch 54 to preclude air compressor 50 and water pump 70 from operate simultaneously. Check valve 55 is disposed between compressor 52 and air storage tank 40. Water pump 70 is controlled by pressure switch 72 preset at suitable limits such as 20 psi "on" and 40 psi "off". Air compressor 50 is controlled by pressure switch 52 preset at suitable limits such as for example 45 psi "on" and "70" psi "off", which will be overridden by interlock switch 54 in any case where water pump 70 is activated. In the case where, for example the settings for pressure switch 52 are 45 psi "on" an "70" psi "off", float 45 opens air valve 28 at a predetermine water level within tank 10, which allows air from tank 40 to into tank 10 until the internal pressure thereof reaches 45 psi. Thus this illustrative 45 psi maximum pressure is controlled by pressure regulator 42 which provides more air to water storage tank 10 to offset the increase in water volume. This extra air added pressure allows an above normal amount of water to be drawn down before the next pump cycle. During the time tank 10 is pressurized to 45 psi, float 45 and its stem operatively to air valve 28 keep air valve 28 open. Consequently, when water draw down begins—which is accompanied by a resultant reduction in pressure within tank 10—pressure regulator 42 allows additional 45 psi air to enter tank 10. This flow of 45 psi air will continue until the water level in the tank and in turn the position of float 45 both drop sufficiently to allow air valve 28 to close. This operation thus brings the air:water ratio back to a point near the 1:1 optimum balance. In any case where some fine tuning of the system is needed, this may be accomplished by making a slight adjustment, up or down as required, of pressure regulator 42. Accordingly, the coordinated operation of the among the various elements of the fully automatic system controls the volumes of water and headspace air within tank 10 and thereby keeps the system from reaching a condition where an excessive volume ratio of water to headspace air exists within tank 10.

It will be noted that sight glass 22 in the fully automatic system is employed in adjusting the volumes of air and water within tank 10 to the proper balance in the initial installation, and thereafter it serves as a means for periodically checking to be sure that all parts of the system are functioning properly.

Figure 4:
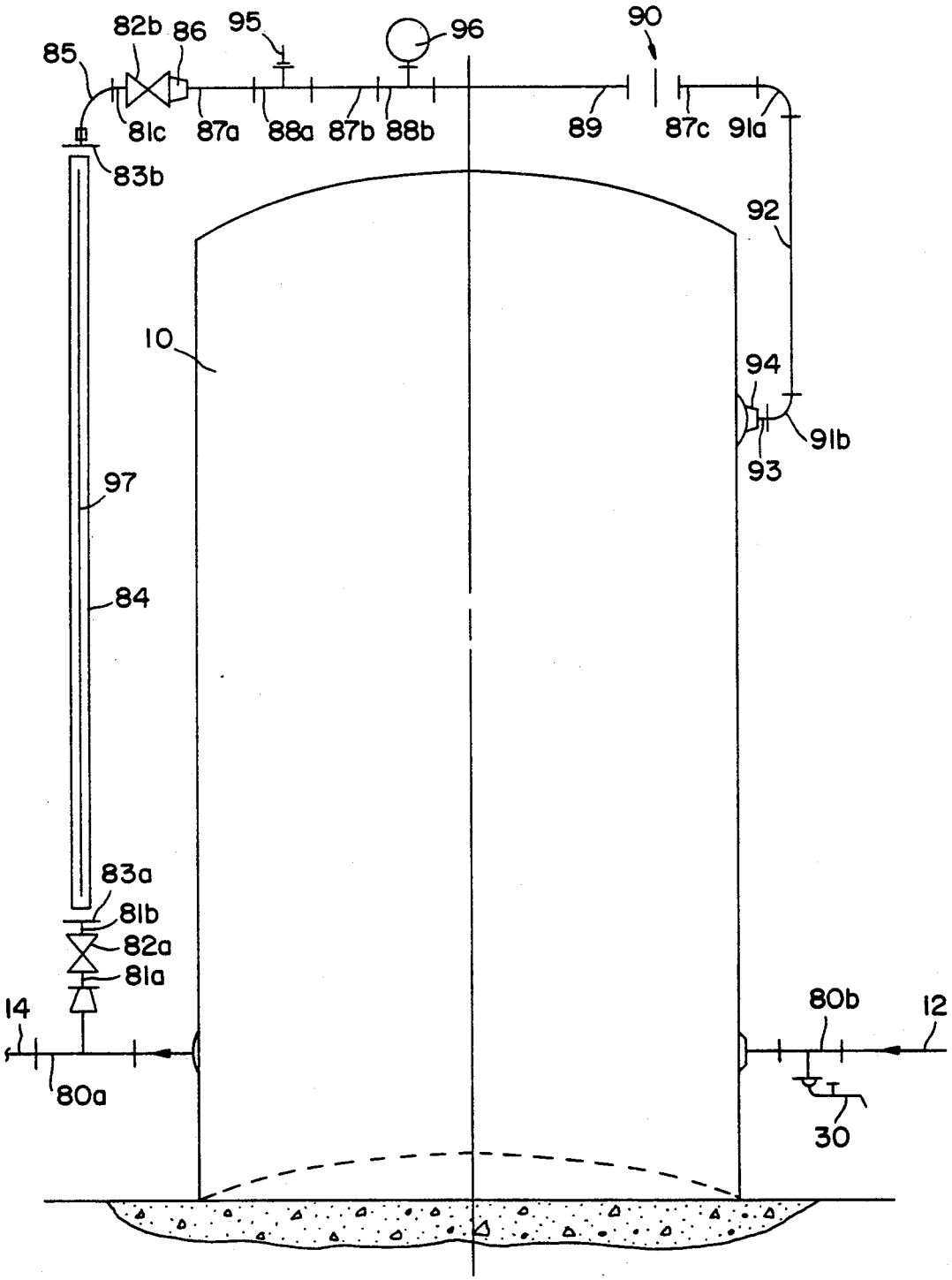
FIG. 4 is a schematic elevation of a manually operated air/water volume control system of this invention identifying, merely because of best mode considerations, each and every part making up a specific system of the invention to permit such minutiae, however unnecessary, to be described.

While materials of construction, sizes and components of the various parts of the systems of this invention can easily be selected by anyone skilled in the art upon a reading and understanding of this disclosure, and while such matters are not critical in the practice of this invention, nevertheless recent interpretations by certain courts of the "best mode" provision of 35 USC 112 appear to make it prudent to burden the disclosure with such minutiae. Thus: for a water storage/delivery tank having a horizontal water outlet line near its base, the individual parts, keyed to FIG. 4 are set forth in Table V wherein all fractions except for parts 83, 84 and 97 represent nominal pipe diameters in inches. In FIG. 4 suffixes that are applied to some of the numerals indicate use two or more of the same part.

TABLE V

| Part No. | No. Used | Description of Part(s) |
|---|---|---|
| 80 | 2 | 1¼" × 1¼" × ½" galvanized iron tees |
| 81 | 3 | ½" galvanized iron nipples |
| 82 | 2 | ½" diameter brass gate valves (female ends) |

TABLE V-continued

| Part No. | No. Used | Description of Part(s) |
|---|---|---|
| 83 | 2 | ⅝" diameter copper flare nuts |
| 84 | 1 | ½" internal diameter Thermo-Clear polycarbonate tubing supplied by Thermoplastic Processes, Inc., Stirling, New Jersey |
| 85 | 1 | ¼" diameter galvanized iron street ell |
| 86 | 1 | ¼" galvanized iron bushing |
| 87 | 3 | ¼" galvanized iron nipples |
| 88 | 2 | ¼" galvanized iron tees |
| 89 | 1 | ¼" galvanized iron pipe |
| 90 | 1 | ¼" galvanized iron union |
| 91 | 2 | ¼" 90° galvanized iron ells |
| 92 | 1 | ¼" galvanized iron pipe |
| 93 | 1 | ¼" galvanized iron nipple |
| 94 | 1 | ¼" galvanized iron bushing |
| 95 | 1 | ¼" air (sniffer) valve |
| 96 | 1 | ¼" pressure gauge |
| 97 | 1 | tape graduated in tenths of inches |

The lengths of the above parts are of course governed by the size of the tank and the amount of space available for installing the system of this invention.

To assemble the parts listed in Table V, the following procedure is recommended: All connections involving metal parts are threaded connections which are sealed to insure against leakage. Commencing at the bottom of the system, tee 80*a* is installed in the horizontal water outlet line 14 so that the tee points upwardly. One nipple, Part 81*a*, is secured into tee 80 so that it also points upwardly. One brass gate valve, Part 82*a*, is secured to part 81*a*. Another nipple, Part 81*b*, is secured to the brass gate valve 82*a*. The polycarbonate tubing, Part 84 is flared on one end, then both flare nuts, Parts 83*a* and 83*b*, are placed on the tubing with the threaded ends of the respective flare nuts extending outward from the respective proximate ends of the tubing. The other end of the tubing is then flared. To effect such flaring, the appropriate end of the tubing is softened by application of heat and while softened is flared so as to match the internal frustoconical shape of the flare nuts. One flare nut, Part 83*a*, is secured to nipple 81*b*. Existing air control apparatus is removed from the existing air control port in the tank and is replaced with a bushing, viz., Part 94. A nipple, Part 93, is secured to bushing 94. An ell, Part 91*b*, is secured to nipple 93. A suitable length of pipe, Part 92, is secured to ell 91*b*. Another ell, Part 91*a*, is secured to the other end of pipe 92 which points toward the other parts of the system already installed. A nipple, Part 87*c*, is secured to ell 91*a*. One end of a union with collar, Part 90, is secured to nipple 87*c* and the other end of the union, Part 90, is secured to the pipe section, Part 89. A tee, Part 88*b*, is secured to the opposite end of the pipe section 89. A nipple, Part 87*b*, is secured to the opposite end of tee 88*b* with the center port of tee 88*b* turned upward. Another tee, Part 88*a* is secured to the opposite end of nipple 87*b*, again with the center port pointing upward. Another nipple, Part 87*a*, is secured to tee 88*a*. A bushing, Part 86, is secured to nipple 87*a*. A gate valve, Part 82*b*, is secured to bushing 86. Another nipple, Part 81*c*, is secured to gate valve 82*b*. The female part of street ell, Part 85, is secured to nipple 81*c* with the male end of the ell pointing downward and lining up with previously installed nipple 81*b*. The piping section which extends from the proximate end of union 90 to street ell 85, is moved into place and the collar portion of union 90 is screwed onto the other end of union 90. The top flare nut, Part 83*b*, of sight glass 84 is screwed onto street ell 85 thereby closing the entire piping system. Air valve, Part 95, is screwed into tee 88*a* and the pressure gauge, Part 96, is screwed into the open port of tee 88*b*. Tape 97 is applied longitudinally to sight glass 84 to facilitate referencing the water level therein and thereby assessing the water level within the water storage/delivery tank 10. At any convenient stage of the assembly procedure, tee 80*b* is inserted into water inlet pipe 12 and drain spout 30 is suitably connected to tee 80*b* either directly or with a suitable length of pipe disposed between them.

Figure 5:
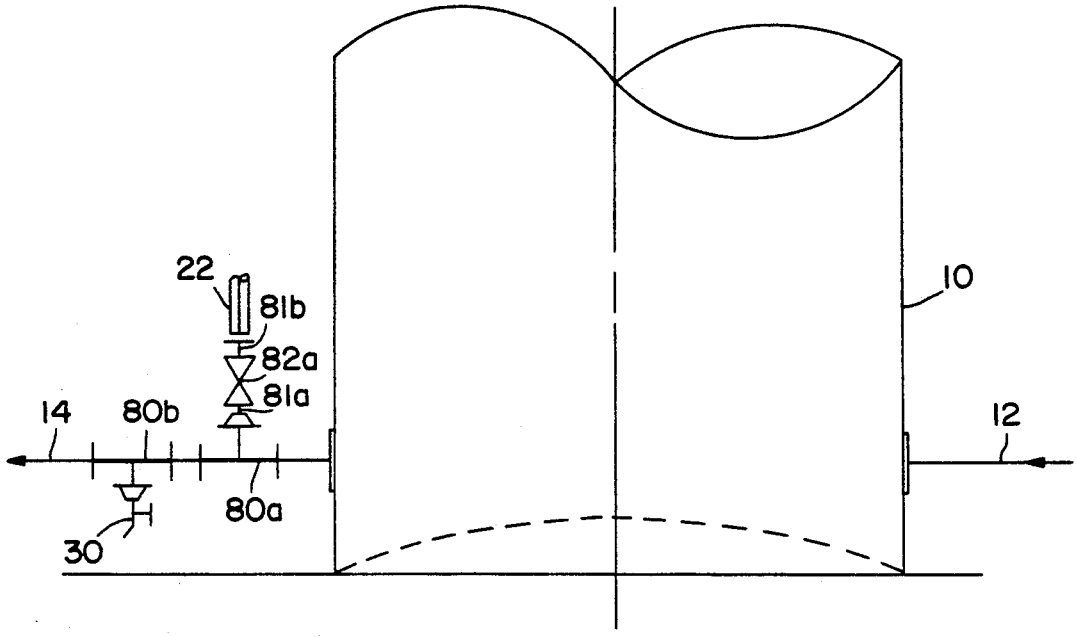
FIG. 5 is a fragmentary schematic elevation of the lower portion of a system of the invention illustrating tank draining means disposed in a location different from those illustrated in FIGS. 1-4.

In FIG. 5 drain spout 30 is connected to outlet pipe 14 by means of a suitable connection to the free end of tee 80*b* inserted into pipe 14. The connection between drain spout 30 and tee 80*b* can either be a direct connection therebetween or an indirect connection, for example with a suitable length of pipe disposed therebetween.

Figure 6:
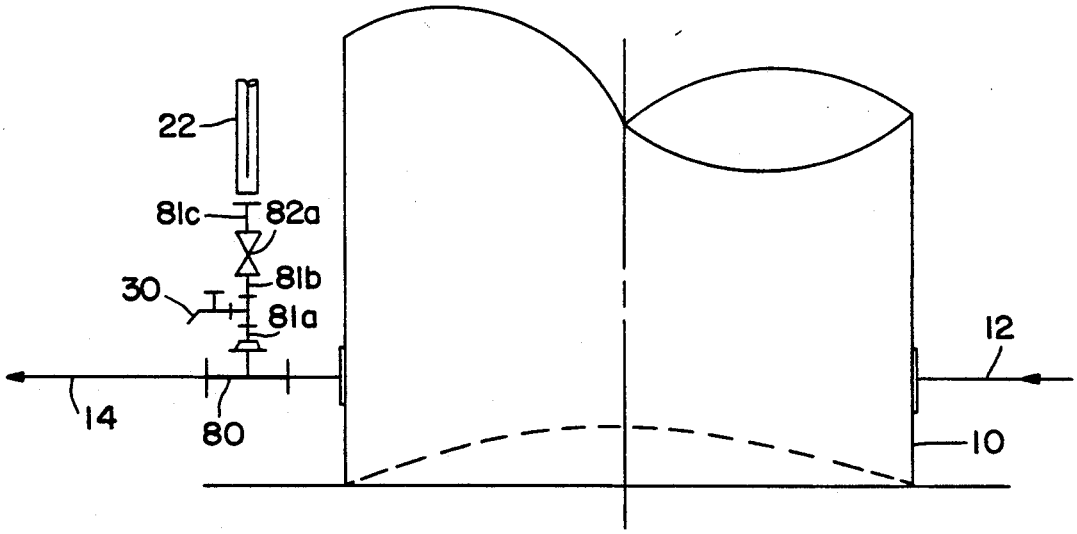
FIG. 6 is a fragmentary schematic elevation of the lower portion of a system of the invention illustrating tank draining means disposed in a location different from those illustrated in FIGS. 1-5.

In FIG. 6, drain spout 30 is connected via a tee to the lower portion of the piping section between nipples 81*a* and 81*b* and below gate valve 82*a*.

Since drain spout 30 enables water to be drained from tank 10 when water drainage is required, it can be located in various positions in the system, such as are illustrated in FIGS. 1–3, 4, 5 and 6, respectively. The positioning of drain spout 30 as in FIGS. 4, 5 or 6 is generally preferred as this allows use of conventional commercially-available tanks without modification of any kind. No extra ports need be drilled into the tank, and specially designed tanks need not be used. Moreover, the arrangements illustrated in FIGS. 4, 5 and 6 are generally sturdier and more secure than when the drain spout is mounted in a port drilled into the tank. The placement of drain spout 30 as in FIG. 4 or as in FIG. 5 is most preferred as these constructions provide the most sturdy installations. When draining the tank, water flow through water inlet pipe 12 may be shut off in any suitable manner, as by shutting off the well pump.

Figure 2:
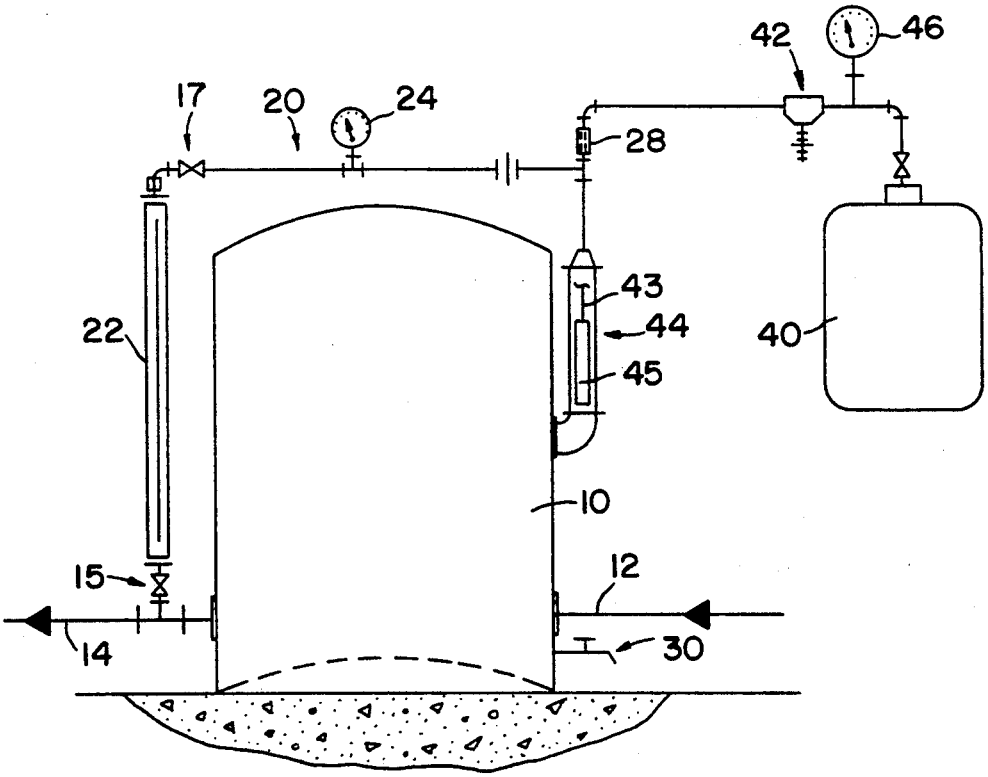
FIG. 2 is a schematic elevation illustrating a semi-automatic air/water volume control system of this invention.

In the case of the systems described in connection with FIGS. 2 and 3, (which utilize most of the system described with reference to FIG. 4), pressure regulator 42 is preferably a Speedaire pressure regulator such as is illustrated and identified as stock number 1Z838 on page 1188 of the Grainger General Catalog No. 377, copyright 1990 by W. W. Grainger, Inc., or equivalent. Float 45 is preferably a 10-inch length of 1"-diameter PVC pipe with end plugs and a ⅛" diameter stem extending axially upwardly through guides so that the upper end of the stem can engage and disengage from air valve 28 to open and close the same. The float is encased and free to float upwardly and downwardly within a vertical length of galvanized iron pipe having an internal diameter of 1¼ inches. Air tank 40 preferably has a volume equivalent to 5 gallons of water.

Figure 3:
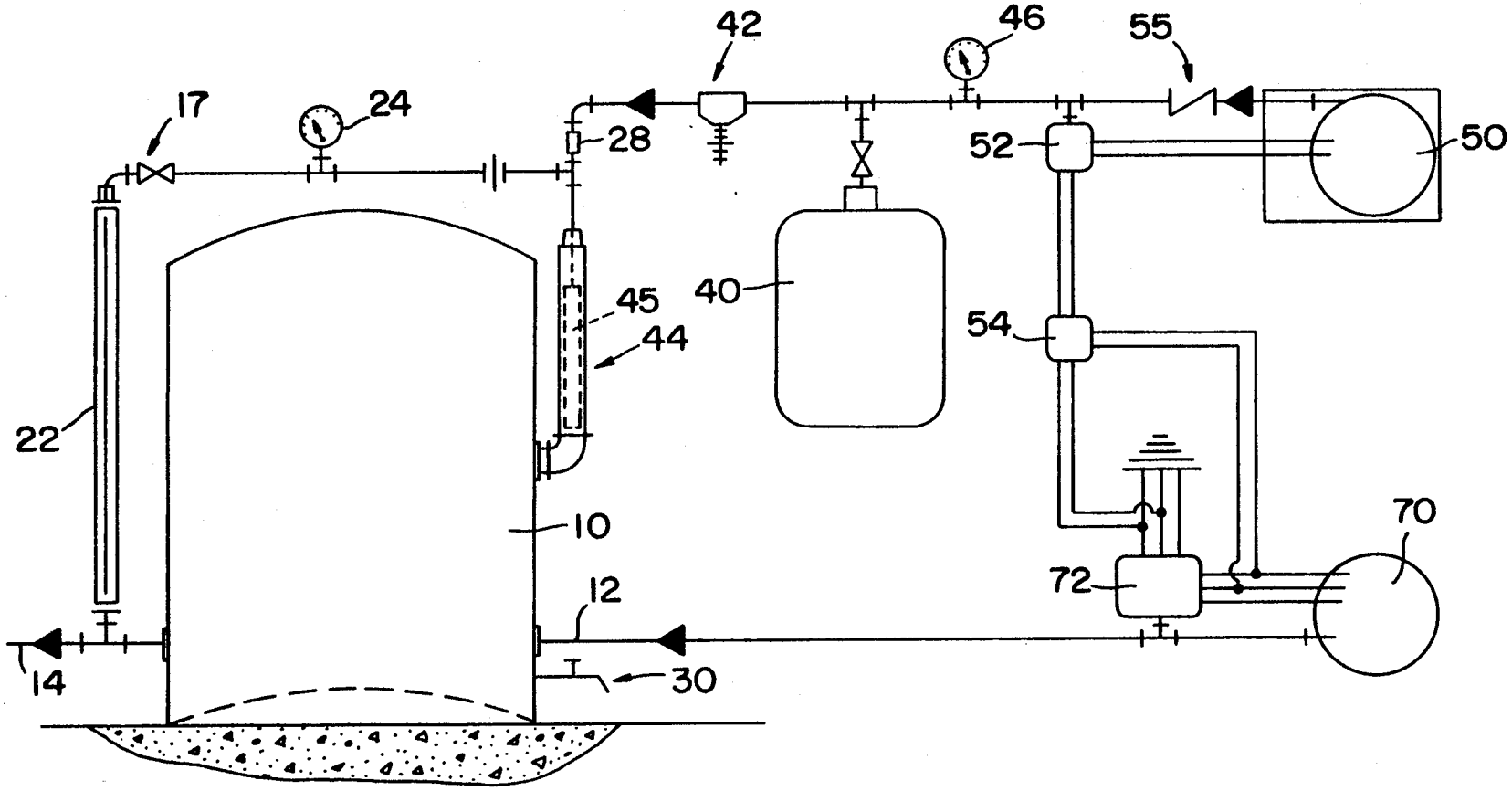
FIG. 3 is a schematic elevation illustrating a fully automatic air/water volume control system of this invention.

In the system of FIG. 3, (which utilizes most of the system described with reference to FIGS. 1, 2 and 4), air compressor 50 is preferably a Black & Decker "Air Station" (trademark) inflator/compressor Model No. 9527 as described in Form No. 741239, copyright 1988 by Black & Decker (U.S.) Inc., Hunt Valley, Md., or equivalent; interlock switch 54 is preferably a Dayton power relay such as is illustrated and identified as stock number 3×745 on page 212 of the Grainger General Catalog No. 377, copyright 1990 by W. W. Grainger, Inc., or equivalent; check valve 55 is preferably a Control Devices Inc. air check valve such as is illustrated and identified as stock number 5×780 on page 1161 of the aforesaid Grainger General Catalog No. 377, or equivalent; pressure switch 72 and the motor of water pump 70 are preferably connected in series to a 230 Volt power supply 74; and interlock switch 54, pressure switch 52, and compressor 50 are preferably connected in series to a 115 Volt power source.

This invention is susceptible to considerable variation in its practice. Thus this invention is not intended to be limited, and should not be limited, to the specific exemplifications presented hereinabove. Rather, what is intended to be covered hereby is the subject matter embraced within the spirit and scope of the appended claims and the full range of equivalents to which this invention is entitled as a matter of law.

What is claimed is:

1. Apparatus for controlling the volumes of water and headspace air in a water storage/delivery tank of an individual water well system which includes a pump for maintaining water within said tank and for maintaining the pressure in the tank within preselected limits, said tank having a water outlet pipe proximate to the bottom of said tank and a port located in said tank at an elevation above a normal water level within said tank and providing communication between the exterior of said tank and the headspace within said tank, said apparatus comprising:

a) a piping section extending between said water outlet pipe said port and including an in-line sight glass enabling visual observation of the water level within said tank;

b) an air conduit connected to said piping section for introducing pressurized air into said piping section;

c) an air pressure gauge for ascertaining the air pressure with the headspace in said tank; and d) an air valve enabling control of the air pressure within the headspace in said tank either by allowing the escape of air from the tank when the headspace air pressure is too high or by allowing pressurized air to be delivered from said air conduit into said tank when the headspace air pressure is too low;

the water level within said tank and the headspace air pressure within said tank being correlated to each other and to the volume of said tank such that adjustment in either (i) the headspace air pressure in said tank or (ii) the water level and the headspace air pressure in said tank is performed only when the ratio between said headspace air pressure and said water level departs by a variance from an optimal ratio between said headspace air pressure and said water level for the volume of said tank.

2. Apparatus according to claim 1 further including draining means to enable water to be drained from said tank when water drainage therefrom is required.

3. Apparatus according to claim 1 wherein said optimal ratio is correlated to the volume of said tank, such that:

A) with a 42-gallon tank said optimal ratio is in accordance with the relationships:

| | | | | |
|---|---|---|---|---|
| Headspace air pressure, psi | 20 | 27 | 33 | 40 |
| Water level in tank, inches | 15 | 17.5 | 19.38 | 20.75 |

B) with a 82-gallon tank said optimal ratio is in accordance with the relationships:

| | | | | |
|---|---|---|---|---|
| Headspace air pressure, psi | 20 | 27 | 33 | 40 |
| Water level in tank, inches | 27 | 32.38 | 35.5 | 38.25 |

C) with a 120-gallon tank said optimal ratio is in accordance with the relationships:

| | | | | |
|---|---|---|---|---|
| Headspace air pressure, psi | 20 | 27 | 33 | 40 |
| Water level in tank, inches | 27.5 | 33.0 | 36.14 | 38.88 |

4. Apparatus as claimed in claim 1 wherein a gate valve is disposed proximate each end of said sight glass so that when necessary the sight glass can be temporarily removed from said apparatus without appreciable loss of internal pressure from said tank.

5. Apparatus for controlling the volumes of water and headspace air in a water storage/delivery tank of an individual water well system which includes a pump for maintaining water within said tank and for maintaining the pressure in the tank within preselected limits, said tank having a water outlet pipe proximate to the bottom of said tank and a port located in said tank at an elevation above a normal water level within said tank and providing communication between the exterior of said tank and the headspace within said tank, said apparatus comprising:

a) a piping section extending between said water outlet pipe and said port and including an in-line sight glass enabling visual observation of the water level within said tank;

b) a float-controlled air injection piping assembly connected to said piping section for introducing pressurized air into said piping section;

c) a source of pressurized air connected to said air injection piping assembly;

d) a valve allowing or preventing the injection of air from said air injection piping assembly into said water storage/delivery tank, the float of said air injection piping assembly being adapted to open said valve when the water level in said water storage/delivery tank reaches a predetermined height therein at which the headspace air pressure is below a prescribed value;

the water level within said tank and the headspace air pressure within said tank being correlated to each other and to the volume of said tank such that adjustment in either (i) the headspace air pressure in said tank or (ii) the water level and the headspace air pressure in said tank is performed only when the ratio between said headspace air pressure and said water level departs by a selected variance from an optimal ratio between said headspace air pressure and said water level for the volume of said tank.

6. Apparatus according to claim 5 further including draining means to enable water to be drained from said tank when water drainage therefrom is required.

7. Apparatus according to claim 5 wherein said adjustment of headspace air pressure is effected automatically by said apparatus.

8. Apparatus according to claim 5 wherein said optimal ratio is correlated to the volume of said water storage/delivery tank, such that:

A) with a 42-gallon tank said optimal ratio is in accordance with the relationships:

| | | | | |
|---|---|---|---|---|
| Headspace air pressure, psi | 20 | 27 | 33 | 40 |
| Water level in tank, inches | 15 | 17.5 | 19.38 | 20.75 |

B) with a 82-gallon tank said optimal ratio is in accordance with the relationships:

| | | | | |
|---|---|---|---|---|
| Headspace air pressure, psi | 20 | 27 | 33 | 40 |
| Water level in tank, inches | 27 | 32.38 | 35.5 | 38.25 |

C) with a 120-gallon tank said optimal ratio is in accordance with the relationships:

| | | | | |
|---|---|---|---|---|
| Headspace air pressure, psi | 20 | 27 | 33 | 40 |
| Water level in tank, inches | 27.5 | 33.0 | 36.14 | 38.88 |

9. Apparatus as claimed in claim 5 wherein said source of pressurized air comprises an air storage tank adapted to maintain therein a supply of air under positive gauge pressure above atmospheric pressure.

10. Apparatus as claimed in claim 9 further comprising means for controlling the pressure of the air entering said air injection piping assembly.

11. Apparatus as claimed in claim 5 wherein said source of pressurized air comprises an air compressor.

12. Apparatus as claimed in claim 5 wherein said source of pressurized air comprises an air storage tank adapted to maintain therein a supply of air under positive gauge pressure above atmospheric pressure, and wherein an air compressor is connected to said air storage tank and is adapted to recharge said air storage tank with air at positive gauge pressure above atmospheric pressure.

13. Apparatus as claimed in claim 12 further comprising means for controlling the pressure of the air entering said air injection piping assembly.

14. Apparatus as claimed in claim 5 wherein said source of pressurized air comprises an air storage tank adapted to maintain therein a supply of air under positive gauge pressure above atmospheric pressure, and an air compressor equipped with a pressure switch preset to actuate said compressor between predetermined pressure limits, said air storage tank and said air compressor both being connected to said air injection piping assembly, and wherein said apparatus further comprises an interlock switch operatively connected so as to preclude said air compressor and said water pump from operating simultaneously.

15. Apparatus as claimed in claim 14 further comprising means for controlling the pressure of the air entering said air injection piping assembly.

16. Apparatus for storing and delivering water from an individual water well system which comprises:

a) a water storage/delivery tank connected to receive water from an individual water well, and adapted to maintain a volume water under a headspace of pressurized air within said b) a pump for delivering water from said well to said tank;

c) a water outlet pipe proximate to the bottom of said tank for delivering water on demand from said tank;

d) said tank having a port located in said tank at an elevation above any normal water level within said tank and providing communication between the exterior of said tank and the headspace within said tank;

e) a piping section extending between said water outlet pipe and said port and including a sight glass enabling visual observation of the water level within said tank;

f) an air conduit connected to said piping section for introducing pressurized air into said piping section;

g) a gauge for ascertaining the air pressure within the headspace in said tank; and h) an air valve enabling control of the air pressure within the headspace in said tank;

the water level within said tank and the headspace air pressure within said tank being correlated such that adjustment in either (i) the headspace air pressure in said tank or (ii) the water level and the headspace air pressure in said tank is performed only when the ratio between said headspace air pressure and said water level departs by a selected variance from an optimal ratio between said headspace air pressure and said water level for the volume of said tank, said optimal ratio being correlated to the volume of said water storage/-delivery tank, such that:

A) with a standard 42-gallon tank said optimal ratio is in accordance with the relationships:

| | | | | |
|---|---|---|---|---|
| Headspace air pressure, psi | 20 | 27 | 33 | 40 |
| Water level in tank, inches | 15 | 17.5 | 19.38 | 20.75 |

B) with a standard 82-gallon tank said optimal ratio is in accordance with the relationships:

| | | | | |
|---|---|---|---|---|
| Headspace air pressure, psi | 20 | 27 | 33 | 40 |
| Water level in tank, inches | 27 | 32.38 | 35.5 | 38.25 |

C) with a standard 120-gallon tank said optimal ratio is in accordance with the relationships:

| | | | | |
|---|---|---|---|---|
| Headspace air pressure, psi | 20 | 27 | 33 | 40 |
| Water level in tank, inches | 27.5 | 33.0 | 36.14 | 38.88 |

17. Apparatus according to claim 16 further including draining means to enable water to be drained from said tank when water drainage therefrom is required.

18. Apparatus according to claim 17 wherein said air control valve is adapted to allow or prevent admission of pressurized air into said piping section and thence into said water storage/delivery tank; and wherein said apparatus further includes (i) a source of pressurized air connected to said air conduit, and (ii) actuating means comprising a float disposed within a vertical portion of said piping section, which portion is separate from but in communication with said sight glass and at a comparable elevation therewith, said actuating means being adapted to open said air control valve when the water level in said water storage/delivery tank reaches a predetermined height therein.

19. Apparatus according to claim 18 wherein said source of pressurized air comprises an air storage tank adapted to maintain therein a supply of air under positive gauge pressure above atmospheric pressure, and an air compressor equipped with a pressure switch preset to actuate said compressor between predetermined pressure limits, said air storage tank and said air compressor both being connected to said air conduit, and wherein said apparatus further comprises an interlock switch operatively connected so as to preclude said air compressor and said water pump from operating simultaneously.

20. Apparatus according to claim 19 wherein a gate valve is disposed proximate each end of said sight glass so that when necessary the sight glass can be temporarily removed from said apparatus without appreciable loss of internal pressure from said water storage/delivery tank.

* * * * *

UNITED STATES PATENT AND TRADEMARK OFFICE

CERTIFICATE OF CORRECTION

PATENT NO. : 5,205,316

DATED : April 27, 1993

INVENTOR(S) : Kearney L. Pruett

It is certified that error appears in the above-identified patent and that said Letters Patent is hereby corrected as shown below:

Column 3, line 40, "Manually controlled system" should be underlined as it is a subheading.

Column 3, line 43, "Which receives Water" should read -- which receives water --.

Column 5, line 26, "Semi-automatically controlled system" should be underlined as it is a subheading.

Column 5, line 63, "Fully-automatically controlled system" should be underlined as it is a subheading.

Column 6, line 4, "operate" should read -- operating --.

Column 6, line 5, "52" should read -- 50 --.

Column 6, line 15, "to into" should read -- to flow into --.

Column 6, line 20, "air added" should read -- air and added --.

UNITED STATES PATENT AND TRADEMARK OFFICE

CERTIFICATE OF CORRECTION

PATENT NO. : 5,205,316

DATED : April 27, 1993

INVENTOR(S) : Kearney L. Pruett

It is certified that error appears in the above-identified patent and that said Letters Patent is hereby corrected as shown below:

Column 6, line 23, "operatively to" should read -- operatively connected to --.

Column 6, line 62, "suffixes" should read -- lettered suffixes --.

Column 9, line 24, "pipe said" should read -- pipe and said --.

Column 9, lines 45-46, "a variance" should read -- a selected variance --.

Signed and Sealed this

Eleventh Day of January, 1994

*Attest:*

Bruce Lehman

BRUCE LEHMAN

*Attesting Officer*

*Commissioner of Patents and Trademarks*